US010738610B2

(12) United States Patent
Kraemer et al.

(10) Patent No.: US 10,738,610 B2
(45) Date of Patent: Aug. 11, 2020

(54) PICK HAVING A SUPPORTING ELEMENT WITH A CENTERING EXTENSION

(71) Applicant: Betek GmbH & Co. KG, Aichhalden (DE)

(72) Inventors: Ulrich Kraemer, Wolfach (DE); Heiko Friederichs, Aichhalden (DE)

(73) Assignee: Betek GmbH & Co. KG (DE)

( * ) Notice: Subject to any disclaimer, the term of this patent is extended or adjusted under 35 U.S.C. 154(b) by 0 days.

(21) Appl. No.: 15/816,050

(22) Filed: Nov. 17, 2017

(65) Prior Publication Data

US 2018/0073359 A1 Mar. 15, 2018

Related U.S. Application Data

(63) Continuation of application No. PCT/EP2017/060157, filed on Apr. 28, 2017.

(30) Foreign Application Priority Data

May 12, 2016 (DE) ..... 10 2016 108 808

(51) Int. Cl.
*E21C 35/18* (2006.01)
*E21C 35/19* (2006.01)
(Continued)

(52) U.S. Cl.
CPC ..... *E21C 35/19* (2013.01); *E21C 35/18* (2013.01); *E21C 35/197* (2013.01); *E21C 35/1933* (2013.01)

(58) Field of Classification Search
CPC ..... E21C 35/18; E21C 35/19
See application file for complete search history.

(56) References Cited

U.S. PATENT DOCUMENTS 5,573,308 A 11/1996 Simons et al.
6,585,327 B2 7/2003 Sollami
(Continued)

FOREIGN PATENT DOCUMENTS

CN 102812206 A 12/2012
CN 204530413 U 8/2015
(Continued)

OTHER PUBLICATIONS

Canadian Office Action (Application No. 2,982,108) dated Jun. 4, 2018.
(Continued)

*Primary Examiner* — Janine M Kreck
(74) *Attorney, Agent, or Firm* — Lucian Wayne Beavers; Patterson Intellectual Property Law, PC

(57) ABSTRACT

A round-shank pick having a pick head and a pick shank that includes a supporting element pierced along its longitudinal center axis by a mounting hole with an inside diameter for receiving the pick shank. A collar height, measured in the direction of the longitudinal center axis between an end, facing away from the seat surface, of the centering extension and the seat surface or between the end of the centering extension and an inner termination of a recess that is integrally formed in the supporting element in an indented manner with respect to the seat surface, is configured such that the ratio between the inside diameter of the mounting hole in the supporting element and the collar height is less than 8, and/or that the collar height is greater than an axial clearance of the pick mounted in a pick holder.

24 Claims, 5 Drawing Sheets

(51) Int. Cl.
*E21C 35/193* (2006.01)
*E21C 35/197* (2006.01)

(56) References Cited

U.S. PATENT DOCUMENTS

| | | | | |
|---|---|---|---|---|
| 6,619,756 | B1 | 9/2003 | Holl et al. | |
| 6,702,393 | B2 | 3/2004 | Mercier | |
| 6,824,225 | B2 | 11/2004 | Stiffler | |
| 6,866,343 | B2 | 3/2005 | Holl et al. | |
| 7,300,115 | B2 | 11/2007 | Holl et al. | |
| 7,597,402 | B2 | 10/2009 | Tewes et al. | |
| 7,784,875 | B2 | 8/2010 | Holl et al. | |
| 7,832,808 | B2 * | 11/2010 | Hall | E21C 35/197 299/104 |
| 8,099,847 | B2 | 1/2012 | Hahn et al. | |
| 8,267,483 | B2 | 9/2012 | Krämer et al. | |
| 8,550,569 | B2 | 10/2013 | Wöhrstein et al. | |
| 8,746,806 | B2 | 6/2014 | Lehnert et al. | |
| 8,746,807 | B2 | 6/2014 | Lehnert et al. | |
| 8,783,785 | B2 | 7/2014 | Lehnert et al. | |
| D711,442 | S | 8/2014 | Brassel et al. | |
| 9,028,008 | B1 | 5/2015 | Bookhamer | |
| RE45,540 | E | 6/2015 | Tewes et al. | |
| 9,109,444 | B2 | 8/2015 | Hahn et al. | |
| 9,144,922 | B2 | 9/2015 | Roth et al. | |
| 9,151,157 | B2 | 10/2015 | Lehnert et al. | |
| 9,163,502 | B2 | 10/2015 | Lehnert et al. | |
| 9,222,354 | B2 | 12/2015 | Allgaier et al. | |
| 9,228,434 | B2 | 1/2016 | Lehnert et al. | |
| 9,260,965 | B2 | 2/2016 | Lehnert et al. | |
| 9,267,373 | B2 | 2/2016 | Kammerer et al. | |
| 9,334,733 | B2 | 5/2016 | Lehnert et al. | |
| 9,376,911 | B2 | 6/2016 | Lehnert et al. | |
| 9,399,914 | B2 | 7/2016 | Roth et al. | |
| 9,719,348 | B2 | 8/2017 | Lehnert et al. | |
| 9,739,145 | B2 | 8/2017 | Lehnert et al. | |
| 9,765,619 | B2 | 9/2017 | Hahn et al. | |
| 9,765,620 | B2 | 9/2017 | Lehnert et al. | |
| 2003/0047985 | A1 | 3/2003 | Stiffler | |
| 2005/0082899 | A1 | 4/2005 | Levankovsky | |
| 2007/0132304 | A1 | 6/2007 | Holl et al. | |
| 2008/0036272 | A1 | 2/2008 | Hall et al. | |
| 2012/0326488 | A1 * | 12/2012 | Lehnert | E21C 35/197 299/104 |
| 2016/0230551 | A1 | 8/2016 | Lehnert et al. | |
| 2017/0030191 | A1 | 2/2017 | Kammerer et al. | |

FOREIGN PATENT DOCUMENTS

| | | | |
|---|---|---|---|
| DE | 602 09 235 | T2 | 8/2006 |
| DE | 20 2010 018 061 | U1 | 2/2014 |
| DE | 10 2014 104 040 | A1 | 9/2015 |
| EP | 1 427 913 | B1 | 2/2006 |
| RU | 2 123 594 | C1 | 12/1998 |
| RU | 2 198 292 | C1 | 2/2003 |
| RU | 2 280 161 | C2 | 7/2006 |
| RU | 2 522 607 | C2 | 7/2014 |
| RU | 2 580 119 | C2 | 4/2016 |
| SU | 1461907 | A1 | 2/1989 |
| SU | 1469124 | A1 | 3/1989 |
| TW | 200909665 | A | 3/2009 |
| TW | 201014963 | A1 | 4/2010 |
| TW | I483798 | B | 5/2015 |
| TW | 201529952 | A | 8/2015 |
| TW | I509148 | B | 11/2015 |
| WO | 97/39221 | A1 | 10/1997 |
| WO | 00/34626 | A1 | 6/2000 |
| WO | 2011048006 | A2 | 4/2011 |
| WO | 2015144450 | A1 | 10/2015 |

OTHER PUBLICATIONS

Taiwanese Office Action (Application No. 106115375) dated Feb. 7, 2018.
International Search Report and Written Opinion (Application No. PCT/EP2017/060157) dated Aug. 14, 2017.
Office Action from corresponding Japan application 2017-562321.
Office Action from corresponding China application.
Russian Office Action (Application No. 2017140043) dated Aug. 15, 2018 (with English translation).

* cited by examiner

PICK HAVING A SUPPORTING ELEMENT WITH A CENTERING EXTENSION

CROSS REFERENCE TO RELATED APPLICATIONS

This application is a continuation of International Application No. PCT/EP2017/060157 filed Apr. 28, 2017, which designated the United States, and claims the benefit under 35 USC § 119(a)-(d) of German Application No. 10 2016 108 808.0 filed May 12, 2016, the entireties of which are incorporated herein by reference.

FIELD OF THE INVENTION

The present invention relates to a pick, in particular a round-shank pick, having a pick head and a pick shank, having a supporting element which has a seat surface on its underside and a centering extension that projects beyond the seat surface, wherein the centering extension has a centering surface that extends in an inclined manner with respect to the longitudinal center axis of the pick and transitions indirectly or directly into the seat surface, and wherein the supporting element is pierced along the longitudinal center axis by a mounting hole with an inside diameter $D_i$ for receiving the pick shank.

The present invention furthermore relates to a tool system having a pick, in particular a round-shank pick, which has a pick head and a pick shank, having a supporting element which has a seat surface on its underside and a centering extension that projects beyond the seat surface, wherein the centering extension has a centering surface that extends in an inclined manner with respect to the longitudinal center axis of the pick and transitions indirectly or directly into the seat surface, wherein the supporting element is pierced along the longitudinal center axis by a mounting hole with an inside diameter $D_i$ for receiving the pick shank, having a pick holder for receiving the pick shank, wherein the pick holder has, facing the supporting element, a wear surface for bearing the seat surface and a centering receptacle for receiving the centering extension of the supporting element.

BACKGROUND OF THE INVENTION

Such a pick and such a tool system are known from DE 10 2014 104 040 A1. Proceeding from a cutting element, the diameter of the pick head increases as far as a flange, which is adjoined by a pick shank. The pick shank, embodied in a cylindrical manner, is held by means of a clamping sleeve in a pick receptacle in a holding extension of a pick holder. Fixing by means of the clamping sleeve allows the pick to rotate about its longitudinal center axis, while axial movement is blocked. Arranged between the pick head and the holding extension is a supporting element, through the central mounting hole of which the pick shank is guided. Toward the pick head, the supporting element has a recess surrounded by a rim, the bottom of the recess representing a supporting surface on which the pick head rests with a bearing surface. Toward the pick holder, the supporting element forms a seat surface which transitions, toward the center of the supporting element, into a centering surface, inclined with respect to the longitudinal center axis of the pick, of a centering extension. In the transition region between the centering surface and the seat surface, a groove is arranged which has a depth of at least 0.3 mm with respect to the seat surface. The top side of the holding extension of the pick holder is formed, toward the pick head, so as to correspond to the underside of the supporting element. It has a wear surface, on which the seat surface of the supporting element rests. The centering extension of the supporting element is radially guided in a centering receptacle of the holding extension. As a result of the wear surface becoming worn during operation of the tool arrangement with the pick, a bead develops on the wear surface of the pick holder in the region of the groove in the supporting element, the bead engaging in the groove. As a result of this engagement, additional lateral guidance of the supporting element is achieved. At the same time, the penetration of excavated material into the region of the pick receptacle is at least reduced by the groove and the bead engaging in the latter, with the result that the rotatability of the pick is maintained and wear is reduced.

In order to ensure the rotatability of the pick about its longitudinal center axis, an axial clearance of the pick in the pick holder is desired. In this case, a greater clearance is provided for larger picks than for smaller picks. If the axial clearance exceeds the height of the centering extension, the lateral guidance of the supporting element by the centering extension is lost. This results in increased wear both of the supporting element and of the pick holder.

DE 602 09 235 T2 discloses a washer for a rotatable cutting pick. The washer has a plurality of ribs on its front side facing the pick head. The ribs can have a curved shape and be arranged in a manner distributed regularly around the circumference of the washer. On the opposite rear side, uniformly distributed recesses can be integrally formed in the washer. Toward a central mounting hole in the washer, the rear side has a centering extension having a sloped edge that extends in an inclined manner with respect to the longitudinal center axis of the washer. With the washer fitted, the centering extension projects into a corresponding chamfer which is arranged circumferentially with respect to a pick receptacle of a pick holder, resulting in lateral guidance of the washer. As a result of the ribs and recesses, the bearing area of the washer is reduced, resulting in improved rotatability of the washer.

In this arrangement, too, on account of the permissible axial clearance of the mounted pick, the lateral guidance of the washer by the centering extension can be lost with the pick raised to the maximum, with the result that the wear to the washer itself and to the pick holder increases considerably. In particular, a wobbling washer movement that is enabled thereby can result in irregular wearing of the end side of the pick holder, with the result that the latter becomes sloped and thus becomes worn more quickly. Furthermore, in the case of a sloped worn end side, the rotatability of the pick can be limited or blocked, resulting in unilateral and rapid wearing of the pick. The radially oriented ribs and recesses do not in this case result in any additional lateral guidance of the washer.

SUMMARY OF THE INVENTION

Therefore, it is the object of the present invention to provide a pick having improved wear behavior. A further object of the present invention is to provide a tool system having such a pick.

The object of the present invention relating to the pick is achieved in that a collar height, measured in the direction of the longitudinal center axis between an end, facing away from the seat surface, of the centering extension and the seat surface or between the end of the centering extension and an inner termination of a recess that is integrally formed in the supporting element in an indented manner with respect to the seat surface, is configured such that the ratio between the inside diameter $D_i$ of the mounting hole in the supporting element and the collar height is less than 8, and/or that the collar height is greater than an axial clearance of the pick mounted in a pick holder. Mounted on a pick holder, the seat surface of the supporting element lies on a wear surface of the pick holder. In this case, the centering extension engages in a centering receptacle integrally formed in the wear surface and thus results in radial stabilization of the positions of the supporting element. If a recess is integrally formed in the seat surface, an extension of the pick holder engages therein. A ratio of less than 8 between the inside diameter $D_i$ of the mounting hole in the supporting element and the collar height ensures sufficient blocking of any lateral movement of the supporting element. Preferably, in this case, the collar height is selected to be greater than the maximum axial clearance expected over the life expectancy of the pick. Thus, even in the case of a pick extracted from the pick receptacle to a maximum extent within the axial clearance, the centering extension results in lateral stabilization of the supporting element. As a result, the wear to the supporting element and to the wear surface of the pick holder can be reduced considerably. This applies, in particular, in the case of an irregular axial load on the supporting element. Such an irregular axial load results, in the case of insufficient lateral stabilization of the supporting element, in asymmetric and thus increased wear to the wear surface of the holder. As a result of the improved lateral guidance of the supporting element according to the invention, more precise centering of the pick guided in the mounting hole in the supporting element takes place, with the result that asymmetric wear to the wear surface is avoided or at least reduced. The low wear to the supporting element and to the wear surface and as a result of the improved centering of the pick, the rotary movement of the pick is stabilized. This causes more uniform wearing and thus an increase in the service life of the pick. The centering extension results, in cooperation with the centering receptacle, in labyrinthine sealing. As a result, the penetration of excavated material and dust into the region of the pick receptacle and of the pick shank is at least reduced. As a result of the selected ratio of less than 8 between the inside diameter $D_i$ of the mounting hole in the supporting element and the collar height, sufficient sealing is ensured, and so no or only little foreign matter passes into the region of the pick receptacle and of the pick shank and blocks the rotary movement of the pick. As a result the wear to the pick is reduced.

Preferably, provision may be made for the ratio between the inside diameter $D_i$ of the mounting hole and the collar height to be less than 7.5, preferably less than 7.0, particularly preferably less than 6.5. At a ratio of less than 7.5, good lateral guidance is achieved even in the case of transverse forces acting directly on the supporting element, for example, on account of striking excavated material. A ratio of less than 7.0 improves the lateral guidance even further, such that even the simultaneous action of axially oriented forces distributed irregularly over the supporting element and of radially acting transverse forces does not result in a wobbling movement of the supporting element with high wear brought about thereby. At a ratio of less than 6.5, sufficient lateral guidance is achieved even toward the end of the service life of the supporting element and of the pick, when the axial clearance of the pick may have increased on account of the wear that has already occurred.

Radially acting guidance of the supporting element and thus of the pick with simultaneously good rotatability of the supporting element and of the pick can be achieved in that the centering extension and/or the recess are arranged in a manner encircling the mounting hole.

The lateral guidance of the supporting element can furthermore be improved in that a plurality of recesses of identical or different depths or at least one recess extending in a spiral shape about the centering extension are integrally formed in the seat surface, and in that the ratio between the inside diameter $D_i$ of the mounting hole in the supporting element and the collar height with respect to one of the recesses or the channels of the spiral-shaped recess, preferably the ratio between the inside diameter $D_i$ of the mounting hole and the greatest collar height determined with respect to a recess or channel, is less than 8. As a result of a plurality of recesses arranged radially alongside one another and corresponding extensions, engaging in the recesses, of the pick holder, the projected area in the axial direction is retained, but the contact area between the pick holder and the supporting element in the radial direction is enlarged. As a result, greater transverse forces can be absorbed. At the same time, the contact area between the pick holder and the supporting element is enlarged, with the result that the surface pressure, and consequently also the wear, is reduced. As a result of the recesses located alongside one another and the extensions engaging therein, the sealing action with respect to penetrating excavated material is furthermore improved considerably. As a result of the ratio of less than 8 between the inside diameter $D_i$ of the mounting hole in the supporting element and the collar height, sufficient radial guidance of the supporting element and thus of the pick is achieved even when the supporting element is lifted off the wear surface to the maximum extent within the scope of the axial clearance.

A further improvement in the lateral guidance and in the sealing and thus in the rotatability and in the wear to the pick can be achieved in that a guide rib projects beyond the adjacent seat surface at a distance from the centering extension. In this case, the guide rib advantageously engages in a rib receptacle, corresponding to the guide rib, let into the wear surface of the pick holder.

The centering extension is advantageously received in a centering receptacle integrally formed in the pick holder and mounted in a rotatable manner therein. The guide rib integrally formed on the seat surface of the supporting element then grinds into the wear surface, embodied in a planar manner, of the pick holder during operation of the pick. In order to achieve sufficient lateral guidance of the supporting element before the guide rib has ground a rib receptacle into the pick holder, provision can be made for the recess to be formed between the centering extension and the guide rib, and for the centering extension to have a greater height with respect to the adjacent seat surface than the guide rib.

An essential prerequisite for low wear to the pick, to the supporting element and to the pick holder is the easy and free rotatability of the supporting element and of the pick about the longitudinal center axis of the pick. The rotatability can be improved in that transitions between the centering surface, the seat surface, the recess and/or the guide rib extend in a rectilinear or rounded manner. Sharp edges that block rotation are avoided in this way.

Good lateral guidance of the supporting element can be produced in that the depth of the recess with respect to the seat surface is greater than or equal to 0.3 mm, preferably between 0.3 mm and 2 mm, particularly preferably between 0.5 mm and 1.5 mm. If the recess is selected to be less than 0.3 mm, a sufficiently pronounced extension for sufficient lateral stabilization of the supporting element is not produced. Recesses with a depth of up to 2 mm produce a good sealing action (labyrinth seal) between the extension and the recess. If the depth of the recess is selected to be between 0.5 mm and 1.5 mm, a good combined action between sealing and lateral guidance is produced.

Supporting elements that are suitable for common pick sizes and associated pick holders can be obtained in that the supporting element has a mounting hole with an inside diameter $D_i$ of 20 mm and the collar height is greater than 2.5 mm, and/or in that the supporting element has a mounting hole with an inside diameter $D_i$ of 22 mm and the collar height is greater than 2.75 mm, and/or in that the supporting element has a mounting hole with an inside diameter $D_i$ of 25 mm and the collar height is greater than 3.125 mm, and/or in that the supporting element has a mounting hole with an inside diameter $D_i$ of 42 mm and the collar height is greater than 5.25 mm. For smaller picks, for example for precision milling, supporting elements having an inside diameter $D_i$ of the mounting hole of 20 mm or 22 mm and a collar height of at least 2.5 mm or 2.75 mm, respectively, are suitable. For medium-sized picks, supporting elements with an inside diameter $D_i$ of the mounting hole of 25 mm and a collar height of 3.125 mm are suitable. For large picks and associated pick holders, supporting elements with an inside diameter $D_i$ of the mounting hole of 42 mm and a collar height of at least 5.25 mm can be used. At a ratio of less than 8 between the inside diameters $D_i$ of the mounting holes in the supporting elements and the respective collar heights, correspondingly higher centering extensions are provided for larger supporting elements. This ensures that, in the case of larger picks with correspondingly larger arising forces and a greater axial clearance of the pick, there is sufficient lateral guidance of the supporting elements.

The object of the present invention relating to the tool system is achieved in that a centering height, measured in the direction of the longitudinal center axis between an end, facing away from the wear surface, of the centering receptacle and the wear surface or between the end of the centering receptacle and a maximum point of an extension that projects beyond the wear surface, is configured such that the ratio between the inside diameter $D_i$ of the mounting hole in the supporting element and the centering height is less than 8, and/or that the collar height is greater than an axial clearance of the pick mounted in a pick holder.

As a result of the ratio of less than 8 between the inside diameter $D_i$ of the mounting hole in the supporting element and the centering height, good lateral guidance of the centering extension engaging in the centering receptacle is achieved. If the collar height is greater than the axial clearance of the pick mounted in the pick holder, the good lateral guidance is achieved even when the pick is pulled out of the pick holder within its maximum permissible axial clearance and the supporting element can be adjusted in an axial direction in the range of the gap formed in this way between the pick head and the pick holder. The required centering height is provided in a correspondingly larger manner for larger supporting elements and thus for larger tool systems. As a result, even in the case of large tool systems with a correspondingly larger permissible axial clearance of the pick, good lateral guidance of the supporting element is achieved. At the same time, as a result of the centering receptacle and the centering extension, engaging therein, of the supporting element, a pronounced, labyrinthine sealing portion is created, which at least makes it harder for foreign matter to penetrate into the region of the pick mount.

Both the lateral guidance and the sealing action can be improved in that the supporting element rests with its seat surface on the wear surface of the pick holder, and in that at least one extension, projecting beyond the wear surface, of the pick holder is formed in a manner corresponding to a recess, integrally formed in the seat surface, in the supporting element and projects into the recess. The extension and, correspondingly, the recess can in this case be formed in the manner of a fillet or in a trapezoidal or multilevel manner in different contour portions.

The lateral guidance and the sealing action can furthermore be improved in that the supporting element has a guide rib which projects beyond the adjacent seat surface, and in that the pick holder has a rib receptacle which is integrally formed in the wear surface and corresponds to the guide rib and into which the guide rib projects. Combinations are also conceivable in which the seat surface of the supporting element has both at least one guide rib and at least one recess and, in a manner corresponding thereto, the wear surface has at least one rib receptacle and at least one extension.

In accordance with a particularly preferred design variant of the present invention, provision can be made for the extension and/or the rib receptacle to be applied to the wear surface by a shaping process during the production of the pick holder and for the corresponding recess and/or the corresponding guide rib to be formed by abrasion of the seat surface during operation of the tool system, and/or for the recess and/or the guide rib to be applied to the seat surface by a shaping process during the production of the supporting element and for the corresponding extension and/or the corresponding rib receptacle to be formed by abrasion of the wear surface during operation of the tool system. During production, only one component, namely the pick holder or the supporting element, has to be profiled in a corresponding manner. The profiling then grinds into the opposite component during operation. The grinding process can take place over several pick changes. Advantageously, the harder component is profiled. Particularly preferably, the profiling takes place on the seat surface of the supporting element. Corresponding extensions and rib receptacles are then ground into the wear surface of the pick holder during operation. The grinding advantageously takes place during rotational movements of the supporting element. In this case, the supporting element is guided radially by its centering extension in the centering receptacle of the pick holder.

BRIEF DESCRIPTION OF THE DRAWINGS

The present invention is explained in more detail by way of an exemplary embodiment illustrated in the drawings, in which:

in FIG. 1;

DETAILED DESCRIPTION OF THE INVENTION

Figure 1:
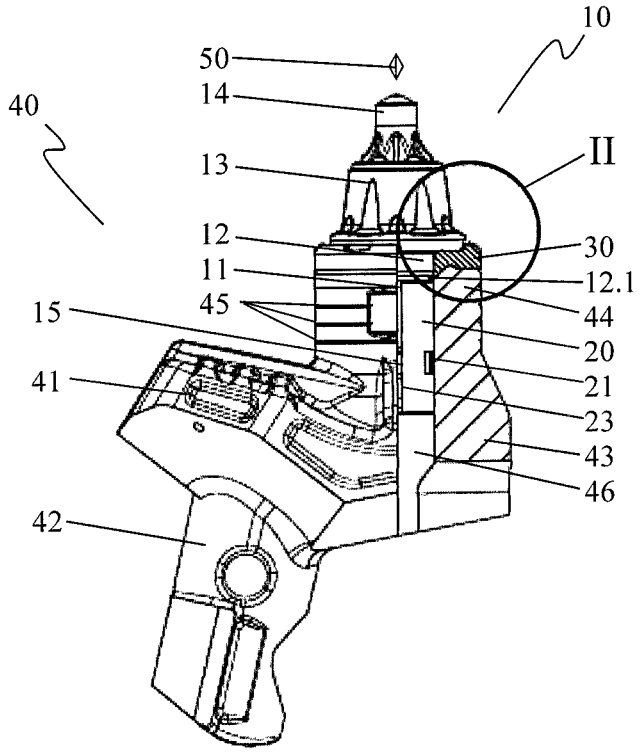
FIG. 1 shows a side view of a tool system having a pick in its mounted position on a pick holder.

FIG. 1 shows a side view of a tool system according to the prior art, having a pick 10 in its mounted position on a pick holder 40. The pick 10, in the form of a round-shank pick, has a pick head 13 with a pick tip 14 made of a hard material, for example carbide. On the opposite side from the pick tip 14, a cylindrical centering portion 12 is integrally formed on the pick head 13, which transitions into a cylindrical pick shank 11 via a narrowing portion 12.1.

The pick holder 40 has a base part 41 on which a plug-in extension 42 that protrudes from the underside is integrally formed. The base part 41 furthermore bears an integrally formed holding extension 43 into which a pick receptacle 46 is introduced as a cylindrical hole. In this case, the pick receptacle 46 is embodied as a through-hole which is open at both of its longitudinal ends. That end of the pick receptacle 46 that faces away from the plug-in extension 42 leads into a cylindrical portion 44 of the holding extension 43. Provided at the outer circumference of the holding extension 43 are wear markings 45 in the form of circumferential rings.

The pick 10 is held on its pick shank 11 by means of a fastening sleeve 20 in the pick receptacle 46 of the pick holder 40. To this end, the fastening sleeve 20 has holding elements 21 which engage in a circumferential groove 15 in the pick shank 11. Furthermore, the fastening sleeve 20 has a clamping slot 23. This makes it possible for the fastening sleeve 20, produced from spring elastic material, to be pressed, on account of its residual stress, against the wall of the pick receptacle 46 and thus to be fixed against the latter. The pick 10 is thus rotatable about its longitudinal axis, but held axially and fixed in the pick receptacle 46. In this case, the axial mounting allows a defined axial clearance 50, indicated by a double arrow, of the pick 10, in order to allow smooth rotatability of the pick 10.

Figure 2:
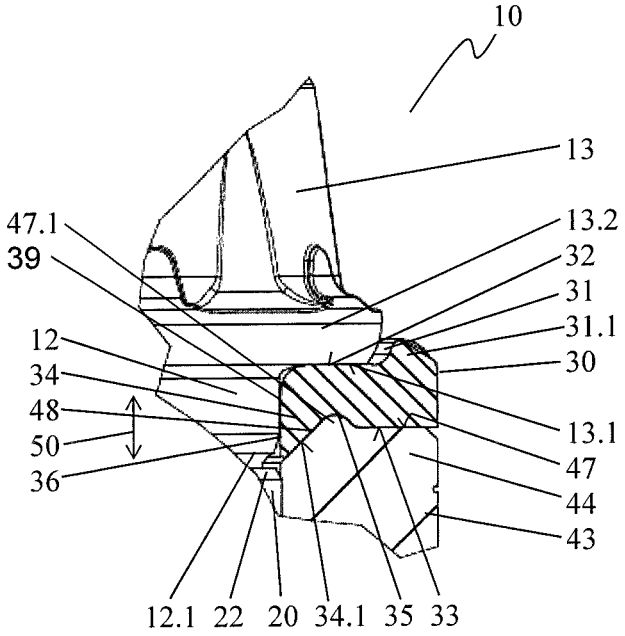
FIG. 2 shows a detail labeled II.

Arranged between the pick head 13 and the pick holder 40 is a supporting element 30 in the form of a washer, as is shown in more detail in FIG. 2, wherein the external contour of the supporting element 30 in the form of a washer follows a geometric shape and/or an arbitrary shape.

For operation, the pick holder 40 is mounted with its plug-in extension 42 in a corresponding holder on a milling drum (not shown) of a milling machine. The pick 10 is fastened to the holding extension 43 of the pick holder 40 by means of the fastening sleeve 20, together with the supporting element 30. During operation, the pick 10 is guided through the excavated material by a rotary movement of the milling drum. In this case, the pick 10 rotates automatically on account of acting forces, such that uniform radial wearing of the pick 10 is achieved.

FIG. 2 shows a detail, labeled II. in FIG. 1, of the tool system having a pick 10 and a supporting element 30 according to the prior art. The pick head 13 is terminated by a flange 13.2 in the direction of the pick shank 11, the flange 13.2 forming a bearing surface 13.1. The latter rests on a supporting surface 32 of the supporting element 30. The supporting surface 32 is formed within a receptacle 31 on the top side of the supporting element 30. It is bounded externally in a corresponding manner by a rim 31.1. On the opposite side from the supporting surface 32, the supporting element 30 has a seat surface 33 by way of which it rests on a wear surface 47 of the cylindrical portion 44 of the holding extension 43. The supporting element 30 is constructed in a substantially rotationally symmetrical manner with respect to a longitudinal center axis (M) of the pick 10. The seat surface 33 transitions via a circumferential recess 35 into a centering surface 34.1, extending in an inclined manner with respect to the longitudinal center axis M, of a centering extension 34. As FIG. 2 clearly illustrates, the centering extension 34 of the supporting element 30 is inserted into a correspondingly formed centering receptacle 48 of the pick holder 40.

Along the longitudinal center axis (M), the supporting element 30 has a mounting hole 39 which forms a guide region 36 for guiding the pick 10. In the mounted position, the centering portion 12 of the pick shank 11 is assigned to the guide region 36. In this way, rotary mounting arises between the guide region 36 and the centering portion 12. In this case, care should be taken to ensure that the outside diameter of the cylindrical centering portion 12 is matched to the inside diameter $D_i$ of the mounting hole 39 in the guide region 36, such that free rotatability remains between the supporting element 30 and the centering portion 12. The clearance between these two components should be selected such that as little lateral misalignment (transversely to the longitudinal center axis of the pick (10)) as possible arises. As already illustrated in FIG. 1, the centering portion 12 transitions into the cylindrical pick shank 11 after a narrowing region 12.1.

The pick shank 11 is held in the holding extension 43 of the pick holder 40 by means of the fastening sleeve 20. At its upper end, the fastening sleeve 20 has a chamfer 22.

During operation, the pick 10 can rotate about the longitudinal center axis. The free rotatability ensures that the pick 10 becomes worn uniformly over its entire extent. In this case, the loosely applied supporting element 30 held by the centering portion 12 of the pick shank 12 also rotates, with the result that the rotatability of the pick 10 overall is further improved. As a result of the rotation and the high mechanical load on the pick 10, wear to the pick holder 40 also takes place, mainly in the upper portion 44 of the holding extension 43. As a result of the load, the wear surface 47 is abraded. The wear present on the holding extension 43 can in this case be evaluated via the wear markings 45 shown in FIG. 1.

As a result of the relative movement between the supporting element 30 and the holding extension 43, the wear surface 47, which is planar in the new state, of the holding extension 43 grinds into the recess 35 in the supporting element 30, as is shown in FIG. 2. By way of an extension 47.1 that forms the contour of the recess 35 in a corresponding manner, the supporting element 30 receives additional lateral guidance, this having a positive effect on the rotatability of the supporting element 30 and thus of the pick 10. The centering surface 34.1 transitions tangentially into the surface of the recess 35, such that no edges that impede the rotatability are formed. In a corresponding manner, the surface of the recess 35 transitions into the seat surface 33 via a rounding portion without sharp edges. With its radially outer surface portion, the recess 35 counteracts forces which act radially inward on the supporting element 30. Forces directed radially outward are counteracted by the radially inner surface portion. As a result, the force which has to be absorbed by the centering surface 34.1 is reduced, this resulting in reduced surface pressure and accordingly in reduced wear in this region. Furthermore, this support also counteracts a wobbling movement in the washer plane of the supporting element 30, bringing about a reduction in wear to the pick holder 40. Moreover, the recess serves, with its counterpart ground out of the wear surface 47, as a labyrinthine seal. Excavated material which passes between the seat surface 33 and the wear surface 47 is prevented from penetrating further by this seal and thus passes into the region of the pick shank 11 only to a reduced extent.

Figure 3:
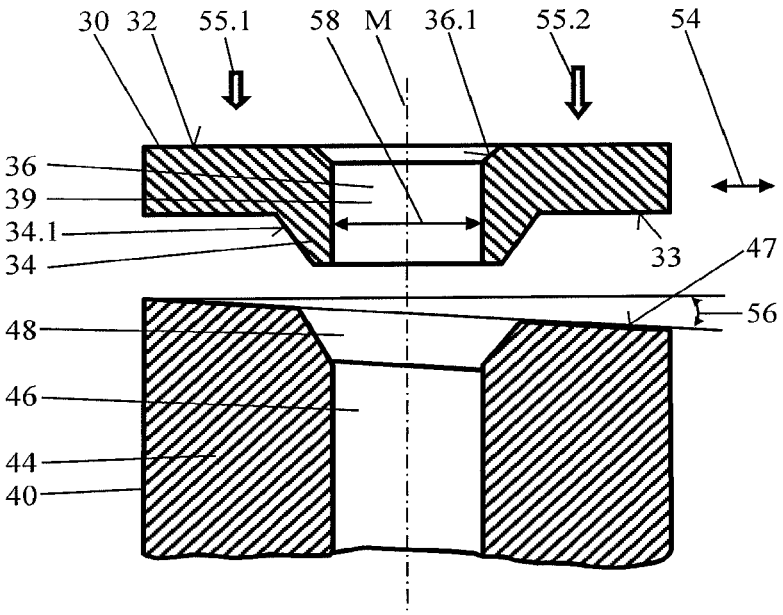
Fig. 3 (PRIOR ART)
FIG. 3 shows a schematic illustration of the wear to a wear surface of a pick holder in the case of a known supporting element.

FIG. 3 shows a schematic illustration of the wear to the wear surface 47 of the pick holder 40 in the case of a known supporting element 30 and in the case of an asymmetric load on the supporting element 30. The supporting element 30 in the form of a washer is bounded, in the embodiment shown, by a planar supporting surface 32 and an opposite seat face 33 that is likewise embodied in a planar manner. The centering extension 34 is integrally formed on the seat surface 33 with its centering surface 34.1 encircling the central mounting hole 39. The mounting hole 39 has an inside diameter $D_i$ 58. On the side of the supporting surface 32, the mounting hole 39 has an insertion chamfer 36.1.

The asymmetric load is illustrated by two arrows of different lengths which symbolize a first force 55.1 and a larger second force 55.2. The asymmetric introduction of force can be brought about for example by the position of the pick holder 40 with respect to the direction of rotation of the milling drum. Such an irregular axial load results, in the case of a relatively large lateral movement (radial movement 54) of the supporting element 30, in asymmetric wear to the wear surface 47 of the pick holder 40. This is indicated by a profile of the wear surface 47 that is inclined at a wear angle 56 with respect to a plane extending perpendicularly to the longitudinal center plane M. The radial movement 54 is allowed in the case of insufficient lateral guidance of the supporting element 30. As a result of such asymmetric wearing of the wear surface 47, the supporting element 30 guiding the pick 10 rests on the wear surface 47 at an angle to the longitudinal center axis M. Thus, the mounting hole 39 is not aligned exactly with the longitudinal center axis M of the pick receptacle 46. As a result of this misalignment, the smooth rotatability of the pick 10 can be impeded or prevented.

Figure 4:
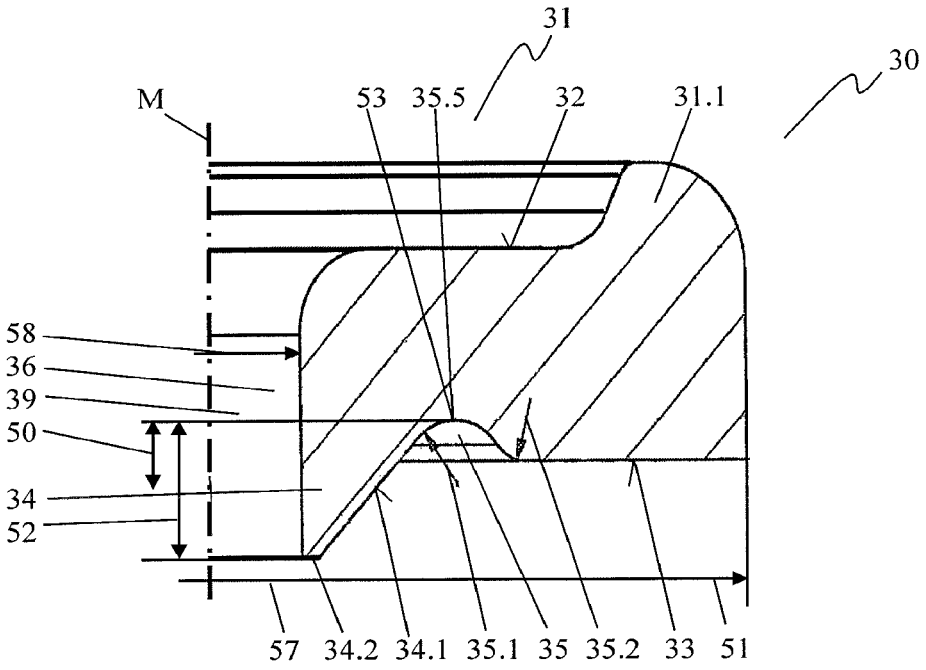
FIG. 4 shows a lateral sectional illustration of a detail of a supporting element in a first embodiment.

FIG. 4 shows a lateral sectional illustration of a detail of a supporting element 30 according to the present invention in a first embodiment.

The supporting surface 32 is arranged in the receptacle 31 for mounting the pick head 13. In the opposing seat surface 33, a groove-like recess 35 is integrally formed in the supporting surface 32 at the transition to the centering surface 34.1 of the centering extension 34. The recess 35 has a first radius 35.1 in a range between 0.5 mm and 6 mm, in the present case 1.5 mm. The depth of the recess 35 with respect to the seat surface 33 is preferably in a range between 0.3 mm and 2 mm, preferably between 0.5 mm and 1.5 mm, in the present case 1.0 mm. The recess 35 transitions into the seat surface 33 via a rounded region with a second radius 35.2. The transition from the recess 35 to the centering surface 34.1 extends in a rectilinear manner. Thus, edges between the centering surface 34.1, the recess 35 and the seat surface 33 are avoided, with the result that free rotatability of the mounted supporting element 30 about the longitudinal center axis M is improved.

A vertex 35.5 forms an inner termination 53 of the recess 35. Remote from the seat surface 33, the centering extension 34 is terminated by a rib-like end 34.2. A collar height 52 is illustrated by a double arrow. In the present exemplary embodiment, the collar height 52 represents the distance, measured in the direction of the longitudinal center axis M, between the end 34.2 of the centering extension 34 and the termination 53 of the recess 35.

In the exemplary embodiment shown, the recess 35 is integrally formed in the seat surface 33 of the supporting element 30. In the mounted state, the supporting element 30 rests with its seat surface 33 on the wear surface 47, shown in FIG. 2, of the pick holder 40. If the wear surface 47 is embodied in a planar manner as far as its transition into the centering receptacle 48, the extension 47.1 grinds during use of the tool system and of the supporting element 30 rotating in the process about the longitudinal center axis M into the recess 35. Alternatively, provision can also be made for the extension 47.1 corresponding to the recess 35 to already be integrally formed on the wear surface 47 during the production of the pick holder 40. In this case, the extension 47.1 can already have its final contour matched to the recess 35. It is also possible for the extension 47.1 to be matched only approximately to the contour of the recess 35 during the production of the pick holder 40. The final contour of the extension 47.1 is then produced during the use of the tool system, in which the extension 47.1 grinds into the recess 35. According to a further possible embodiment, the seat surface 33 can be embodied without an integrally formed recess 35. Instead, the extension 47.1 is integrally formed on the wear surface 47 of the pick holder 40. During operation, the extension 47.1 now grinds into the wear surface 33 of the supporting element 30 and thus forms the recess 35.

An outside diameter 51 of the supporting element 30 and the inside diameter 58 of the mounting hole 39 in the supporting element 30 are each marked by an arrow. The outside diameter 51 corresponds to an outside diameter 57 of the seat surface 33 in the exemplary embodiment shown.

According to the present invention, the collar height 52 is designed such that the ratio between the inside diameter 58 of the mounting hole 39 in the supporting element 30 and the collar height 52 adopts a value of less than 8. The collar height 52 is in this case predefined by the axial dimensions of the centering extension 34 and the recess 35.

At a ratio of less than 8 between the inside diameter 58 of the mounting hole 39 in the supporting element 30 and the collar height 52, good lateral guidance of the supporting element 30 and thus of the pick 10 is ensured. In particular, the collar height 52 is in this case designed so as to be greater than the axial clearance 50 of the pick 10 and thus of the supporting element 30. The dimensioning of the collar height 52 in dependence on the inside diameter 58 of the mounting hole 39 in the supporting element 30 takes into consideration the greater permissible axial clearance 52 in larger tool systems. Thus, regardless of the tool size, sufficient lateral guidance of the supporting element 30 and thus of the pick 10 is always ensured.

On account of the centering surface 34.1 bearing against the centering receptacle 48, good radial guidance of the supporting element 30 is achieved even in the case of maximum deflection of the pick 10, within the permissible axial clearance 50, out of the pick receptacle 46. By way of the recess 35 and the extension 47.1, engaging therein, of the pick holder 40, further lateral guidance of the supporting element 30 is achieved. Lateral movements or wobbling movements of the supporting element 30 can thus be reliably avoided. As a result, the wear to the supporting element 30 and to the pick holder 40 can be reduced considerably. Asymmetric wear to the wear surface 47 given irregular loading of the supporting element 30, as is described with regard to FIG. 2, can be avoided or at least greatly minimized. On account of the remaining angular offset of the wear surface 47, as bearing surface of the supporting element 30 and thus of the pick 10, with regard to the longitudinal center axis M, consistently good rotation of the pick 10 and of the supporting element 30 is achieved. Likewise, exact lateral guidance of the pick 10 takes place as a result of its centering portion 12 of the pick shank 11 bearing against the guide region 36 of the supporting element 30. As a result of the exact lateral guidance of the supporting element 30 and thus of the pick 10 and the resultant reduced wear to the supporting element 30 and to the pick holder 40, stabilization of the rotational movement both of the supporting element 30 and of the pick 10 is achieved. As a result, the wear in particular to the pick 10 and to the pick head 13 can be reduced.

Furthermore, at a ratio of less than 8 between the inside diameter 58 of the mounting hole 39 in the supporting element 30 and the collar height 52, an improved sealing action with respect to penetrating foreign matter by the mutually engaging contours of the supporting element 30 and the top side of the holding extension 43 of the pick holder 40 is achieved than in tool systems having a ratio of greater than or equal to 8. Thus, for example, less excavated material penetrates into the region of the pick receptacle 46, with the result that the wear in this region is reduced and the rotatability of the pick 10 is ensured.

The easy rotatability of the supporting element 30 and of the pick 10 is furthermore maintained by the rounded or rectilinearly extending and thus edge-free transitions between the centering surface 34.1, the receptacle 35 and the seat surface 33. Sharp transitions easily result in the supporting element 30 tilting with respect to the pick holder 40 and rotation being prevented. This can be avoided by the rounded or rectilinearly extending transitions.

FIGS. 5 to 14 each show schematic lateral sectional illustrations of a detail of a supporting element 30 in further embodiments.

In the exemplary embodiments shown in FIGS. 5 to 11 and 13 and 14, the supporting elements 30 have a planar supporting surface 32. Alternatively, however, it is possible in each case, in a manner corresponding to the exemplary embodiment in FIG. 4, to provide a receptacle 31, bounded by a rim 31.1, on the top side of the supporting element 30. The receptacle 31 then forms the supporting surface 32 on which the pick head 13 rests with its bearing surface 13.1. At the transition from the supporting surface 32 into the guide region 36, an insertion chamfer 36.1 is arranged. Alternatively, the transition can also be embodied in a rounded manner.

In the exemplary embodiments corresponding to FIGS. 5 to 12, the outside diameter 51 of the supporting element 30 corresponds to the outside diameter 57 of the respective seat surface 33. In the exemplary embodiments corresponding to FIGS. 13 and 14, a folded edge 38 is arranged encircling the seat surface 33. The outside diameter 51 of the supporting element 30 is accordingly greater than the outside diameter 57 of the associated seat surface 33 in these exemplary embodiments.

Figure 5:
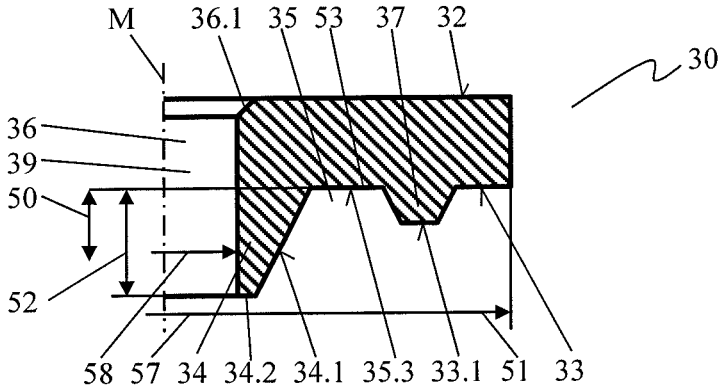
FIGS. 5-14 each show schematic lateral sectional illustrations of a supporting element in further embodiments.

In the exemplary embodiment of a supporting element 30 shown in FIG. 5, a guide rib 37 is arranged on the seat surface 33. The guide rib 37 extends at a distance from the centering extension 34. It has a trapezoidal contour with lateral surfaces extending at an angle to the seat surface 33. Toward the pick holder 40, the guide rib 37 is terminated by a seat-surface portion 33.1. The recess 35 is formed between the centering extension 34 and the guide rib 37. It, too, has a trapezoidal contour. The termination 53 of the recess 35 is formed by a bearing surface 35.3. In the exemplary embodiment shown, the bearing surface 35.3 is located in the same plane as the seat surface 33 to the side of the guide rib 37. Toward the longitudinal center axis M, the bearing surface 35.3 transitions into the centering surface 34.1, extending in an inclined manner, of the centering extension 34. The centering extension 34 is terminated toward the pick holder 40 by its rib-like end 34.2.

The collar height 52 is measured in the direction of the longitudinal center axis between the end 34.2 of the centering extension 34 and the termination 53 of the recess 35, as is illustrated by a double arrow. The ratio between the inside diameter 58 of the mounting hole 39 in the supporting element 30 and the collar height 52 is selected to be less than 8, in the present case less than 6.5. As a result, good lateral guidance of the supporting element 30 and a good sealing action with respect to penetrating foreign matter is achieved with the described advantages. At a ratio of less than 6.5, sufficient lateral guidance is also achieved toward the end of the service life of the supporting element 30 and of the pick 10, when the axial clearance 50 of the pick 10 may have increased on account of the wear that has already occurred.

It is conceivable to configure the collar height 52 at the centering extension 34 with a longitudinal extent which results in a ratio between the inside diameter 58 of the mounting hole 39 in the supporting element 30 and the collar height 52 of greater than 8. As a result, improved support of the centering surface 34.1 on the inner surface of the pick receptacle 46 and/or improved support of the outer surface of the collar height 52 with the outer surface of the free region of the pick shank can be achieved.

In the mounted state, the guide rib 37 rests on the wear surface 47 of the pick holder 40. As a result of the rotation of the supporting element 30, it grinds into the wear surface 47 and thus forms a corresponding rib receptacle in the end face of the pick holder 40. As a result, both the lateral guidance of the supporting element 30 and the sealing action are improved considerably.

Differing from the embodiment illustrated, the transition from the centering surface 34.1 to the bearing surface 35.3 and/or the transition from the bearing surface 35.3 to the adjoining lateral surface of the guide rib 37 and/or the transition from the opposite lateral surface of the guide rib 37 to the adjoining seat surface 33 can be rounded. Likewise, the transitions from the lateral surfaces to the seat-surface portion 33.1 can be embodied in a rounded manner. In this way, sharp edges can be avoided. This results in improved rotatability of the supporting element 30.

Figure 6:
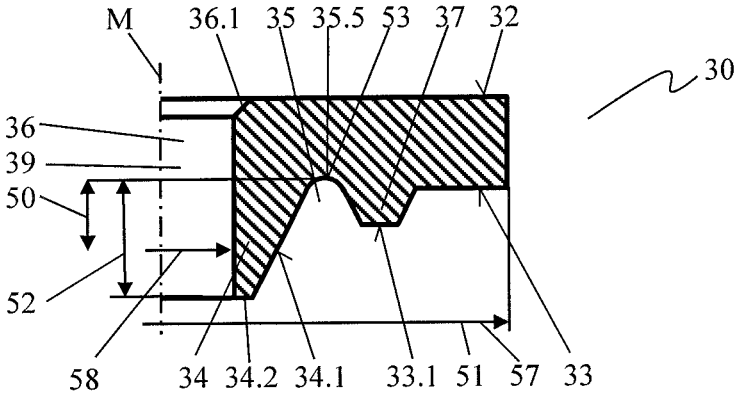

In the case of the supporting element 30 shown in FIG. 6, a trapezoidal guide rib 37 is likewise arranged on that side of the supporting element 30 that faces the pick holder 40. A recess 35 formed between the guide rib 37 and the centering extension 34 has a contour in the form of a fillet. The radius of the recess 35 is in this case selected such that its surface transitions tangentially into the centering surface 34.1 and the adjoining lateral surface of the guide rib 37. The collar height 52 corresponds to the distance, extending in the direction of the longitudinal center axis M, between the end 34.2 of the centering extension 34 and the vertex 35.5 of the recess 35 in the form of a fillet. As a result of the immediately successive combination of centering extension 34, recess 35 and guide rib 37, a good sealing action with respect to penetrating material is achieved in conjunction with a correspondingly formed wear surface 47 of a pick holder 40.

Figure 7:
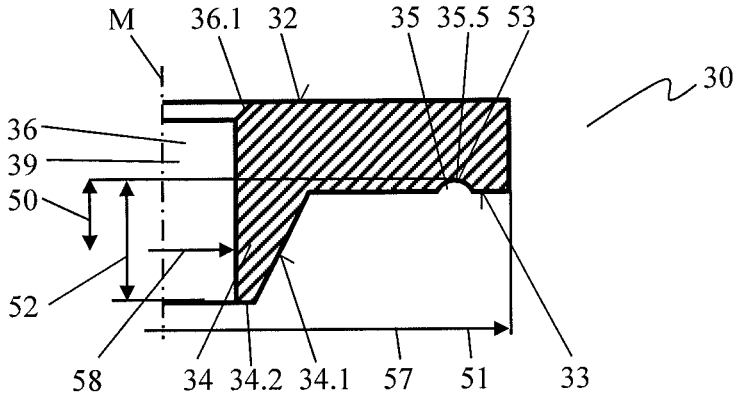

The seat surface 33 of the supporting element 30 shown in FIG. 7 transitions directly into the centering surface 34.1 of the centering extension 34. In the outer region of the seat surface 33, a groove-like recess 35 is let into the seat surface 33. The collar height 52 is measured along the longitudinal center axis M between the end 34.2 of the centering extension 34 and the vertex 35.5 of the groove-like recess 35. The recess 35 arranged comparatively far to the outside on the supporting element 30 results in particularly good stabilization of the rotational movement of the supporting element 30.

Figure 8:
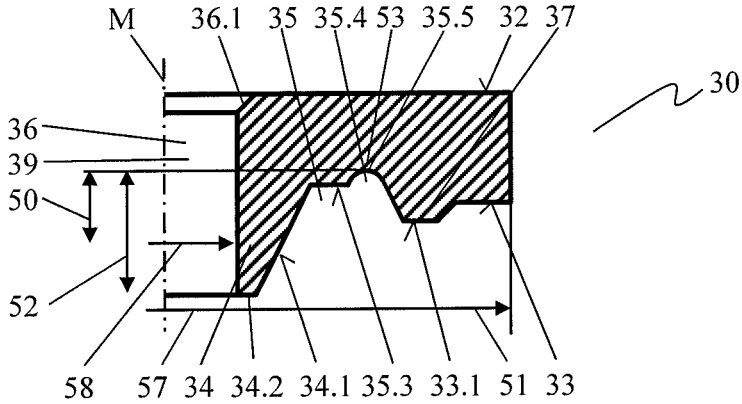

FIG. 8 shows a supporting element 30 with a recess 35 embodied in a multilevel manner and a guide rib 37. The centering surface 34.1 extends into the recess 35 and transitions there into a bearing surface 35.3 arranged transversely to the longitudinal center axis M, in particular perpendicularly to the longitudinal center axis M. The bearing surface 35.3 is adjoined, as a further depression of the recess 35, by a groove-like region 35.4. The surface of the groove-like region 35.4 transitions tangentially into the adjoining lateral surface of the guide rib 37. The trapezoidally shaped guide rib 37 forms a seat-surface portion 33.1 which is connected to the further seat surface 33 via the external lateral surface of the guide rib 37. The bearing surface 35.3, the seat-surface portion 33.1 and the external seat surface 33 extend transversely, in particular perpendicularly to the longitudinal center axis M. In this case, the bearing surface 35.3 is integrally formed more deeply in the supporting element 30 than the seat surface 33. The collar height 52 is measured between the end 34.2 of the centering extension 34 and the vertex 35.5 as a termination 53 of the groove-like region 35.4 of the recess 35.

The different planes in which the supporting surface 33, the supporting-surface portion 33.1 and the bearing surface 35.3 are arranged result both in good lateral guidance of the supporting element 30 and in a good sealing action.

Figure 9:
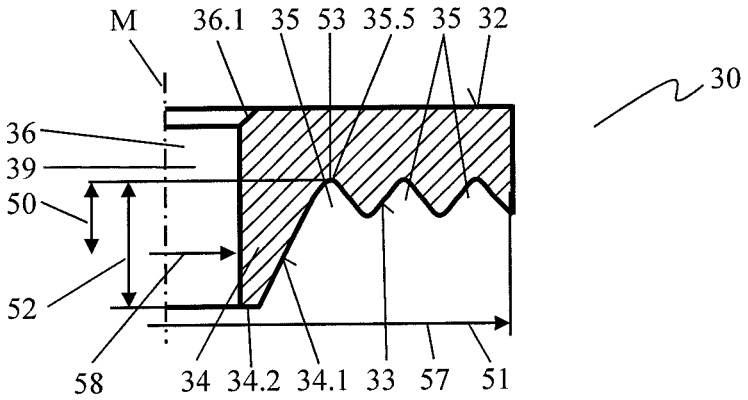

In the exemplary embodiment of the supporting element 30 shown in FIG. 9, concentrically arranged recesses 35 are integrally formed in the supporting element 30, around the centering extension 34. A wavy contour is thus formed, the surface of which represents the seat surface 33. Differing therefrom, provision can also be made for the recesses 35 to be formed by a channel encircling the centering extension 34 in a spiral shape. The collar height 52 is measured between the end 34.2 of the centering extension 34 and the vertex 35.5 of the innermost recess 35. In the case of adjacent recesses 35 with different depths, the collar height 52 is preferably determined as far as the termination 53 of the deepest recess 35. The recesses 35 arranged encircling the centering extension 34 ensure good rotatability of the supporting element 30. Furthermore, the engagement of corresponding extensions 47.1 of the pick holder 40 results in a good sealing action. As a result of the wavy contour, the area projected in the axial direction remains the same as a planar area, such that the axial supporting action is retained. The radially active area is enlarged considerably by the lateral flanks of the recesses 35. As a result, transverse forces can be absorbed better. On account of the wave shape, the contact area between the supporting element 30 and the pick holder 40 shown in FIG. 1 is enlarged. As a result, the surface pressure between the supporting element 30 and the pick holder 40 is reduced, resulting in reduced wear and in improved rotatability.

Figure 10:
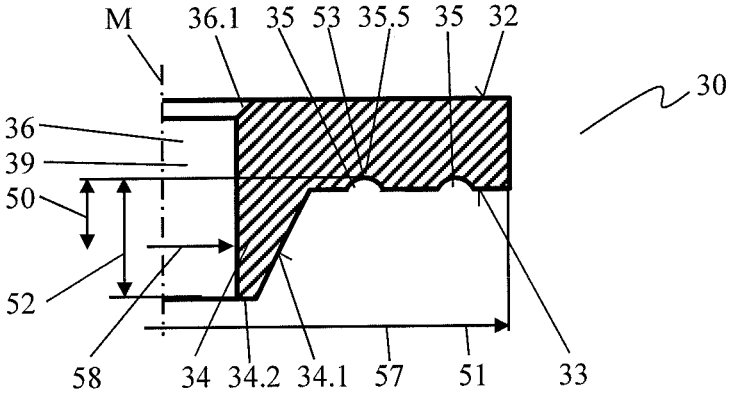

FIG. 10 shows a supporting element with a planar seat surface 33, into which two concentrically extending, groove-like recesses 35 are incorporated. In this arrangement, too, good rotatability, good lateral stabilization and a good sealing action with respect to penetrating excavated material are achieved.

Figure 11:
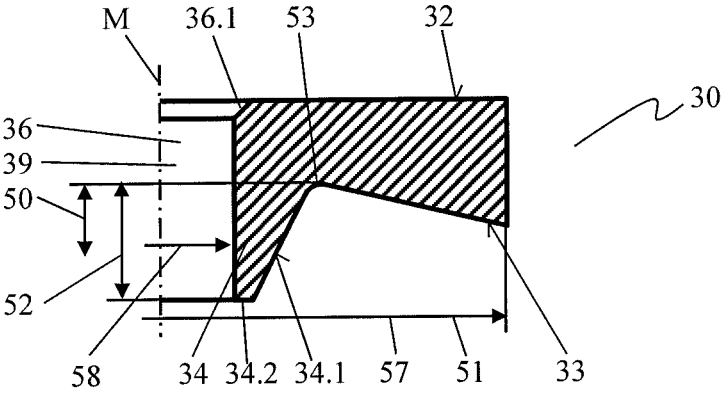

The supporting element 30 illustrated in FIG. 11 has a seat surface 33 that extends in a rectilinear manner but is oriented at an angle to the longitudinal center axis M. In this case, the maximum depth into the supporting element 30 is formed in the transition region, embodied in a rounded manner, from the centering surface 34.1 into the wear surface 33. Both the centering surface 34.1 and the wear surface 33 have a radially stabilizing effect on the position of the supporting element 30 on account of their orientation at an angle to the longitudinal center axis M. The collar height 52 is measured from the end 34.2 of the centering extension 34 to the termination 53 in the transition region from the centering surface 34.1 to the wear surface 33.

Figure 12:
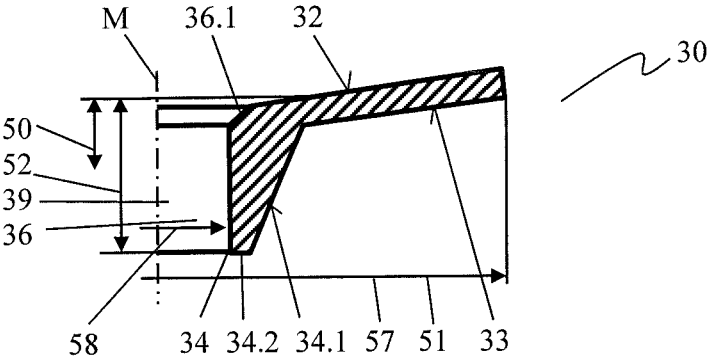

In the case of the supporting element 30 shown in FIG. 12, both the supporting surface 32 and the seat surface 33 extend at an angle to the longitudinal center axis M. The supporting surface 32 and the seat surface 33 are in this case arranged preferably in a plane-parallel manner to one another. The greatest distance, measured in the direction of the longitudinal center axis M, between the end 34.2 of the centering portion 34 and the seat surface 33 arises toward the outer rim of the supporting element 30, and so this distance forms the collar height 52. In this exemplary embodiment, too, both the centering surface 34.1 and the seat surface 33 oriented at an angle to the longitudinal center axis M act in a radially stabilizing manner on the supporting element 30.

Figure 13:
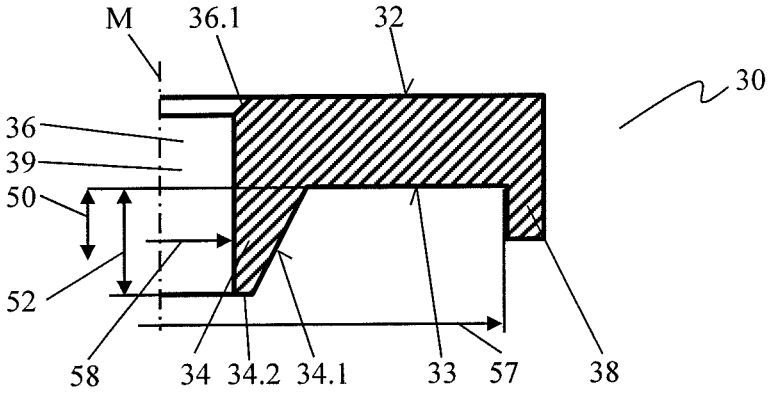

FIG. 13 shows a supporting element 30 with an outer folded edge 38. The centering surface 34.1 of the centering extension 34 transitions into the supporting surface 33 extending in a planar manner. The supporting surface 33 is preferably oriented perpendicularly to the longitudinal center axis M. The outside diameter 57 of the seat surface 33 is selected to be slightly greater than the diameter of the wear surface 47 of the pick holder 40. The folded edge 38, embodied in a rectangular manner in the exemplary embodiment shown, extends in the direction of the pick holder 40. In the mounted state, it engages around the upper portion 44 of the holding extension 43 and thus results in additional lateral stabilization of the supporting element 30. Furthermore, the folded edge 38 protects the region between the pick holder 40 and the supporting element 30 from penetrating material. In order to avoid tilting of the supporting element 30, the transitions from the centering surface 34.1 into the seat surface 33 and from the seat surface 33 to the folded edge 38 can be embodied in a rounded manner. The collar height 52, as the distance between the end 34.2 of the centering portion 34 and the seat surface 33, is marked by a double arrow.

Figure 14:
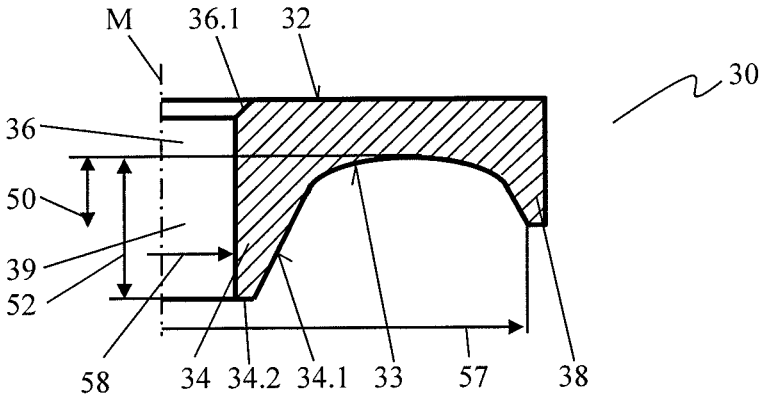

FIG. 14 also shows a supporting element 30 with a folded edge 38 engaging around the holding extension 43 of the pick holder 40. In this case, the seat surface 33 is embodied in an inwardly curved manner. As a result, compared with the exemplary embodiment shown in FIG. 13, improved lateral guidance and also improved rotatability about the longitudinal center axis M of the supporting element 30 are achieved. The distance between the end 34.2 of the centering extension 34 and the inner termination 53 of the seat surface 33 corresponds to the collar height 52.

In all of the exemplary embodiments according to the present invention that are shown, the respective collar height 52 is designed to be greater than the permissible axial clearance 50 of the pick 10 and thus of the supporting element 30. As a result, even in the event of a maximum deflection of the pick 10 out of the pick receptacle 46, sufficient lateral guidance of the supporting element 30 is achieved. As a result of the different possible contours of that side of the supporting element 30 that faces the pick holder 40, and the top side, designed in a corresponding manner, of the pick holder 40, the lateral guidance and sealing with respect to penetrating foreign matter can be adapted to the applicable requirements. What is essential here is that the ratio between the inside diameter 58 of the mounting hole 39 in the supporting element 30 and the respective collar height 52 is less than 8, since, starting from this ratio, the radial movement of the supporting element 30 is blocked such that increased wear, as is caused by a radial movement of the supporting element 30, is ruled out.

Tests by the applicant have revealed that, for example, the configuration of a centering extension 34, a guide rib 37 and/or a recess 35 with an interrupted contour profile, for example as a rib-like contour profile or a plurality of individual recesses 35 distributed over the contour profile, has a positive effect on the grinding behavior of a rotating pick on the end face of the holder shank. The result observed is that the ground-in centering extension 34 forms what is known as a labyrinth seal on the end face of the holder shank, in order in this way to protect the inner hole 39 from undesired contamination or in order to be able to remove contaminants in a targeted manner from the cavity forming between a centering extension 34, a guide rib 37 and/or a recess 35 and the end face of a holder shank on account of an axial displacement of the pick. In this case, such interruptions can be formed additionally in a radial longitudinal extent with different lengths, in order to further improve the removal of contaminants.

Furthermore, the relief of the pressure that arises on account of the rotational movement of the pick in the holder can be improved.

The invention claimed is:

1. A tool system, comprising:

a pick including a pick head and a pick shank, the pick having a longitudinal center axis;

a supporting element including:

a mounting hole extending through the supporting element, the mounting hole having an inside diameter configured to receive the pick shank;

a seat surface defined on an underside of the supporting element;

a centering extension projecting beyond the seat surface, the centering extension including a centering surface extending in an inclined manner relative to the longitudinal center axis, the centering extension transitioning indirectly or directly into the seat surface;

a recess formed in the seat surface; and wherein the supporting element has a collar height measured parallel to the longitudinal center axis between an end of the centering extension facing away from the seat surface and an inner termination of the recess of the seat surface, a ratio between the inside diameter of the mounting hole and the collar height being less than 8.0; and a pick holder including:

a wear surface facing the supporting element such that the supporting element rests with the seat surface on the wear surface of the pick holder, the supporting element being rotatable relative to the wear surface of the pick holder;

at least one extension projecting beyond the wear surface and configured to be received in the recess of the supporting element; and a centering receptacle for receiving the centering extension of the supporting element, the centering receptacle having a centering height measured parallel to the longitudinal center axis, the centering height extending between an end of the centering receptacle facing away from the wear surface and a maximum point of projection of the at least one extension, a ratio of the inside diameter of the mounting hole to the centering height being less than 8.0.

2. The tool system of claim 1, wherein:

the ratio between the inside diameter of the mounting hole and the collar height is less than 7.5.

3. The tool system of claim 1, wherein:

the ratio between the inside diameter of the mounting hole and the collar height is less than 7.0.

4. The tool system of claim 1, wherein:

the ratio between the inside diameter of the mounting hole and the collar height is less than 6.5.

5. The tool system of claim 1, wherein:

the centering extension and the recess encircle the mounting hole.

6. The tool system of claim 1, wherein:

the supporting element includes a guide rib projecting beyond the seat surface at a distance from the centering extension.

7. The tool system of claim 6, wherein:

the recess is formed between the centering extension and the guide rib; and the centering extension has a greater height with respect to the seat surface than does the guide rib.

8. The tool system of claim 1, wherein:

transitions between the centering surface, the recess and the seat surface extend in a rectilinear or rounded manner.

9. The tool system of claim 1, wherein:

the recess has a depth with respect to the seat surface greater than or equal to 0.3 mm.

10. The tool system of claim 1, wherein:

the recess has a depth with respect to the seat surface between 0.3 mm and 2 mm.

11. The tool system of claim 1 wherein:

the recess has a depth with respect to the seat surface between 0.5 mm and 1.5 mm.

12. The tool system of claim 1, wherein:

the inside diameter of the mounting hole is about 20 mm, and the collar height is greater than 2.5 mm.

13. The tool system of claim 1, wherein:

the inside diameter of the mounting hole is about 22 mm, and the collar height is greater than 2.75 mm.

14. The tool system of claim 1, wherein:

the inside diameter of the mounting hole is about 25 mm, and the collar height is greater than 3.125 mm.

15. The tool system of claim 1, wherein:

the inside diameter of the mounting hole is about 42 mm, and the collar height is greater than 5.25 mm.

16. The tool system of claim 1, wherein:

the pick and the pick holder are configured such that the pick has an axial clearance in the pick holder; and the collar height is greater than the axial clearance.

17. The tool system of claim 1, wherein:

the supporting element includes a guide rib projecting beyond the seat surface; and the pick holder includes a rib receptacle formed in the wear surface, the guide rib projecting into the rib receptacle.

18. The tool system of claim 17, wherein:

the at least one extension and the rib receptacle are formed on the wear surface by a shaping process during the production of the pick holder; and the recess and the guide rib are formed by abrasion of the seat surface during operation of the tool system.

19. The tool system of claim 17, wherein:

the recess and the guide rib are formed on the seat surface by a shaping process during the production of the supporting element; and the at least one extension and the rib receptacle are formed by abrasion of the wear surface during operation of the tool system.

20. The tool system of claim 1, wherein:

the at least one extension is formed on the wear surface by a shaping process during the production of the pick holder; and the recess is formed by abrasion of the seat surface during operation of the tool system.

21. The tool system of claim 1, wherein:

the recess is formed on the seat surface by a shaping process during the production of the supporting element; and the at least one extension is formed by abrasion of the wear surface during operation of the tool system.

22. The tool system of claim 1, wherein:

the supporting element includes a guide rib projecting beyond the seat surface; and the centering extension, the guide rib and/or the recess has an interrupted contour profile.

23. The tool system of claim 22, wherein:

interruptions in the contour profile have one or more radial longitudinal extents with different lengths.

24. The tool system of claim 1, wherein:

the recess is one of a plurality of recesses of identical or different depths or at least one recess extending in a spiral shape about the centering extension; and the ratio between the inside diameter of the mounting hole and the collar height is determined using the one of the recesses having a greatest collar height.

* * * * *